US007934362B2

(12) United States Patent
Buchko et al.

(10) Patent No.: US 7,934,362 B2
(45) Date of Patent: May 3, 2011

(54) BELT DRIVEN CLAMPING ARRANGEMENT FOR GRIPPING AND ADVANCING WEB MATERIAL IN A PACKAGING MACHINE

(75) Inventors: Raymond G. Buchko, Neenah, WI (US); Dwayne C. Long, New London, WI (US)

(73) Assignee: CP Packaging, Inc., Appleton, WI (US)

( * ) Notice: Subject to any disclaimer, the term of this patent is extended or adjusted under 35 U.S.C. 154(b) by 237 days.

(21) Appl. No.: 12/057,916

(22) Filed: Mar. 28, 2008

(65) Prior Publication Data

US 2009/0241486 A1 Oct. 1, 2009

(51) Int. Cl.
*B65B 47/04* (2006.01)
*B65B 47/10* (2006.01)
*B65H 20/16* (2006.01)

(52) U.S. Cl. ..... 53/559; 53/453; 53/456; 226/170

(58) Field of Classification Search ..... 53/453, 53/456, 559; 226/170–173
See application file for complete search history.

(56) References Cited

U.S. PATENT DOCUMENTS 3,303,628 A * 2/1967 Lovas et al. ..... 53/433
3,773,235 A * 11/1973 Canamero et al. ..... 226/112
4,336,680 A * 6/1982 Grevich ..... 53/389.2
4,397,411 A * 8/1983 Vetter et al. ..... 226/173
4,580,711 A * 4/1986 Iimura ..... 226/158
4,593,893 A * 6/1986 Suter ..... 270/52.12
4,826,065 A * 5/1989 Natterer et al. ..... 226/173
4,897,985 A 2/1990 Buchko et al.
4,915,283 A 4/1990 Buchko et al.
4,944,442 A 7/1990 Buchko
4,987,728 A * 1/1991 Ventura ..... 53/559
5,048,268 A * 9/1991 Brembilla et al. ..... 53/511
5,205,110 A 4/1993 Buchko
5,349,768 A * 9/1994 Ishihara et al. ..... 38/143
5,682,729 A * 11/1997 Buchko ..... 53/453
6,282,866 B1 * 9/2001 Natterer et al. ..... 53/282

* cited by examiner

*Primary Examiner* — Hemant M Desai
(74) *Attorney, Agent, or Firm* — Boyle Fredrickson, S.C.

(57) ABSTRACT

A packaging machine includes a clamping arrangement, composed of a series of clamps designed to grip and release a web of flexible material, and which are coupled to a belt that is advanced along a predetermined path to advance the web of flexible through the machine. The belt is made up of side-by-side belt portions that are spliced together in axially spaced locations by the clamps, to withstand the forces and stresses placed thereon as the web material is advanced. Each clamp is formed of an upper jaw member and a lower jaw member that are pivotably interconnected together, in combination with a guide member the guides movement of the belt through the machine. The belts are independently driven by operation of a pair of motors, which are synchronously operated in order to advance the opposite edges of the web material at the same rate of speed through the machine.

16 Claims, 6 Drawing Sheets

BELT DRIVEN CLAMPING ARRANGEMENT FOR GRIPPING AND ADVANCING WEB MATERIAL IN A PACKAGING MACHINE

BACKGROUND OF THE INVENTION

The present invention relates generally to packaging systems that deform a web of flexible material into product-holding cavities and, more particularly, to a belt-driven clamping arrangement that advances the web of flexible material through the various stations of a packaging system.

Conventional packaging machines that deform a web of flexible material into product-holding cavities, such as described in U.S. Pat. No. 4,915,283, have a clamping arrangement in the form of a pair of spaced apart clip chains that grip the edges of the web and advance the web through the machine. In this regard, the clips or clamps used to grip and release the web of flexible material are mounted at predefined positions along the length of the chain. When the chain is taut, the position of the clamps can be controlled; however, over time, the chain can wear and become loose and, thus, the position of the clamps can become difficult to control. In this regard, periodic shut-downs of the packaging system are required for maintenance of the chain.

In addition, prior art packaging machines utilizing a chain-type clamping arrangement involve the use of a drive motor that rotates a drive shaft, and a pair of drive sprockets that are mounted to the drive shave. Each drive sprocket is engaged with one of the clip chains. The drive shaft extends across the width of the packaging machine, and is operable to synchronously drive the drive sprockets so as to move the clip chains together. With this construction, the components of the machine must be arranged so as to provide clearance for the drive shaft. In addition, in the event the chains wear unevenly, this arrangement can result in the opposite edges of the web material being advanced at slightly different rates of speed through the machine, which can cause skewing and wrinkling of the web material.

BRIEF DESCRIPTION OF THE INVENTION

It is an object of the present invention to overcome the drawbacks associated with a chain driven web advancement device in a packaging machine. It is another object of the invention to provide a web advancement mechanism that can maintain its length and thus remain taut notwithstanding the normal forces and stresses placed on the advancement mechanism during operation. Yet another object of the invention is to provide a web advancement mechanism that enables the normal forces and stresses encountered at the splice of the driving member to be efficiently and effectively withstood. A further object of the invention is to provide a packaging machine which eliminates the use of a drive shaft that extends across the machine to drive the web advancement components on opposite sides of the machine.

Therefore, in accordance with one aspect of the invention, a material advancement apparatus for carrying web material through a packaging machine is disclosed. The apparatus includes a motor assembly and a belt operatively driven by the motor assembly along a predetermined path. The apparatus further includes a clamp arrangement including a plurality of clamps coupled to the belt and adapted to selectively grip and release the web material.

In accordance with another aspect, the invention contemplates a packaging machine having a formation station that deforms a web of flexible material to form a cavity adapted to receive a product to be packaged. The packaging machine further has a supply of flexible web material and a belt assembly associated with the supply of flexible web material and operable to advance the web material along a continuous and predetermined path to the formation station.

According to another aspect, the present invention includes a clamping arrangement for a packaging machine that packages products in flexible web material. The clamping arrangement includes a plurality of clamps, each of which has a channel guide member adapted to engage a guide of the packaging machine, a lower jaw member coupled to the channel guide member, and an upper jaw member coupled to the lower jaw member in a manner that allows the upper jaw member to pivot relative to the lower jaw member.

In accordance with yet another aspect, the present invention includes a pair of spaced apart, endless web material advancement components on opposite sides of the machine, which are operable to grip the edges of the web material. A drive arrangement is engaged with the web material advancement components, and includes a pair of drive motors located one on each side of the machine. Each drive motor is engaged with one of the web material advancement components, and the drive motors are operated synchronously in order to move the opposite edges of the web material at the same rate of speed through the machine. This arrangement eliminates the need for a drive shaft extending across the machine as in the prior art, which allows other components of the machine to be located in the space the would normally be occupied by the drive shaft.

Other aspects, features, and advantages of the invention will become apparent to those skilled in the art from the following detailed description and accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout.

In the drawings.

DETAILED DESCRIPTION OF THE DRAWINGS

Figures 1, 8:
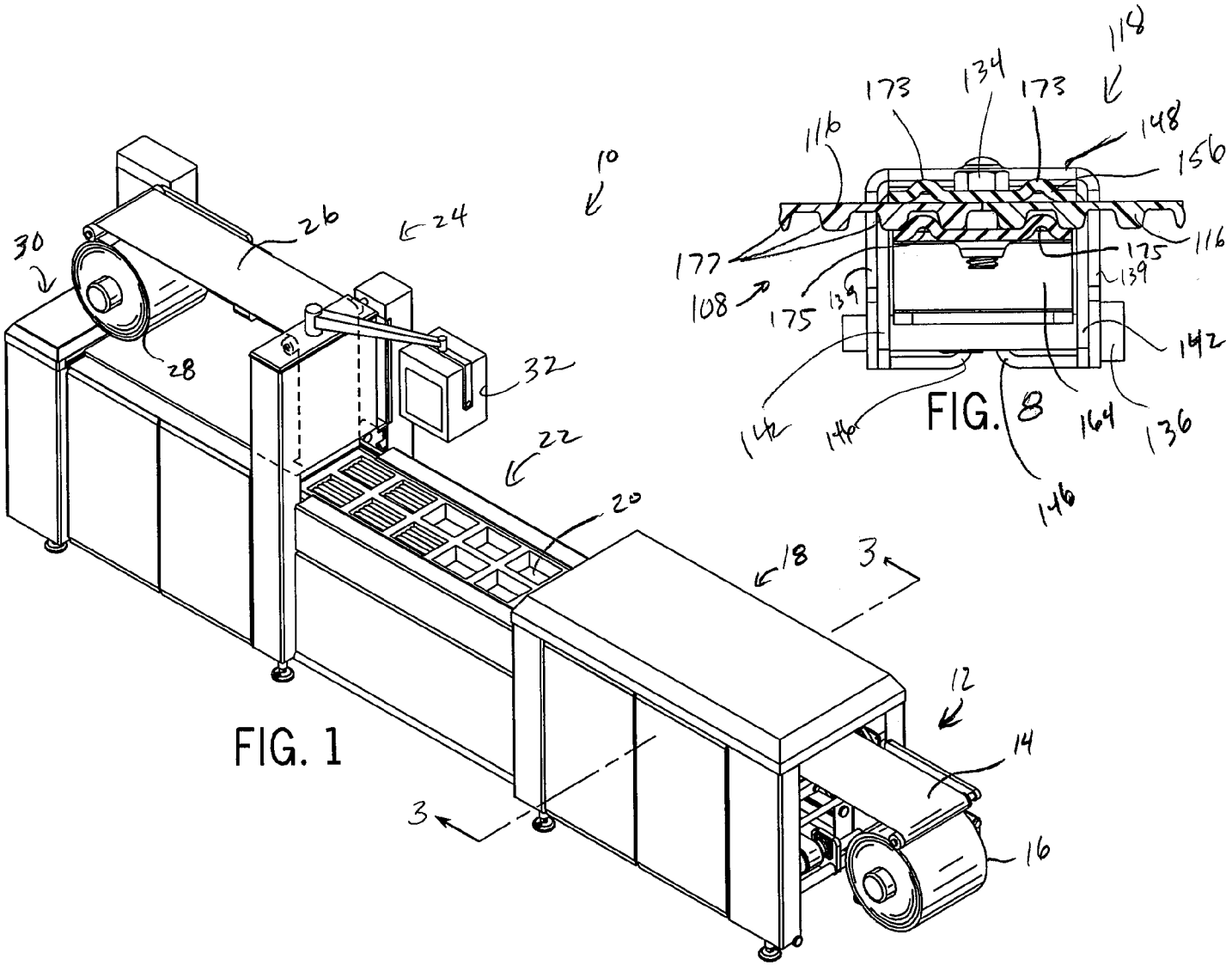
FIG. 1 is an isometric view of a packaging machine incorporating the web advancement mechanism of the present invention.
FIG. 8 is a section view of the packaging machine of FIG. 1 taken along line 8-8 of FIG. 7.

FIG. 1 illustrates a packaging machine 10 that generally includes a lower web supply station 12 for supplying a lower web 14 of flexible web material from a supply roll 16 to a formation station 18. The lower web 14 of flexible material is advanced to the formation station 18, where cavities 20 are formed in the lower web 14. The deformed lower web 14 is then presented to a loading station 22 where a user or machine loads products, e.g., hot dogs, cheese, meat or any other edible or non-edible product, into the cavities 20. After product is loaded into the cavities 20, the lower web material 14 is advanced to an upper web station 24 that supplies an upper web 26 of flexible material from a supply roll 28. As is known in the art, upper web 26 of flexible material is placed atop the loaded cavities 20, and the upper and lower webs of flexible material are then advanced to an evacuation and sealing station 30 that evacuates the loaded cavities 20 and seals the upper and lower webs of flexible material together. As is known in the art, the evacuation and sealing station 30 may include a web heating assembly that heats and bonds the upper web 26 and the lower web 14 together. The sealed packages may then be presented to a cutting station (not shown) for separating the product packages formed by the sealed upper and lower webs, a labeling station (not shown), and a bulk packaging station (not shown) as generally understood in the art. As further known in the art, the packing machine 10 may also include a control unit 32 that presents a touch screen, for instance, to allow a user to control the packaging machine 10 while proximate the loading station 22.

Figure 2:
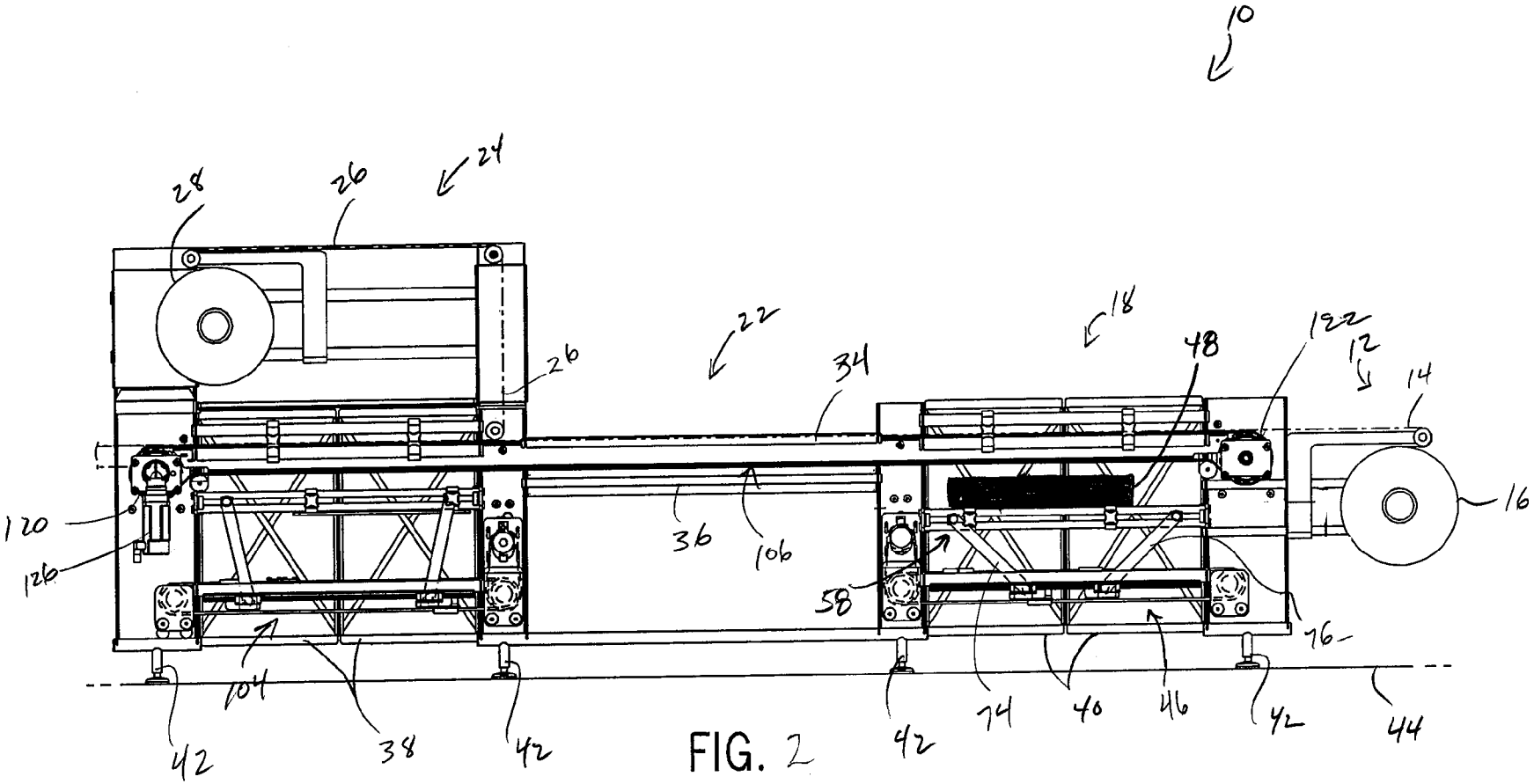
FIG. 2 is a side elevation view of the packaging machine of FIG. 1, with guards and covers removed to expose the components of the machine.

With further reference to FIG. 2, the various components of the packaging machine 10 are supported by a frame assembly that includes a pair of spaced parallel upper frame members 34, and lower spaced frame members such as shown at 36, 38, and 40. Legs 42 support the frame members in a raised position above a support surface such as a floor 44. A similar construction is described in U.S. Pat. No. 5,205,110, the entire disclosure of which is incorporated herein by reference.

Figure 3:
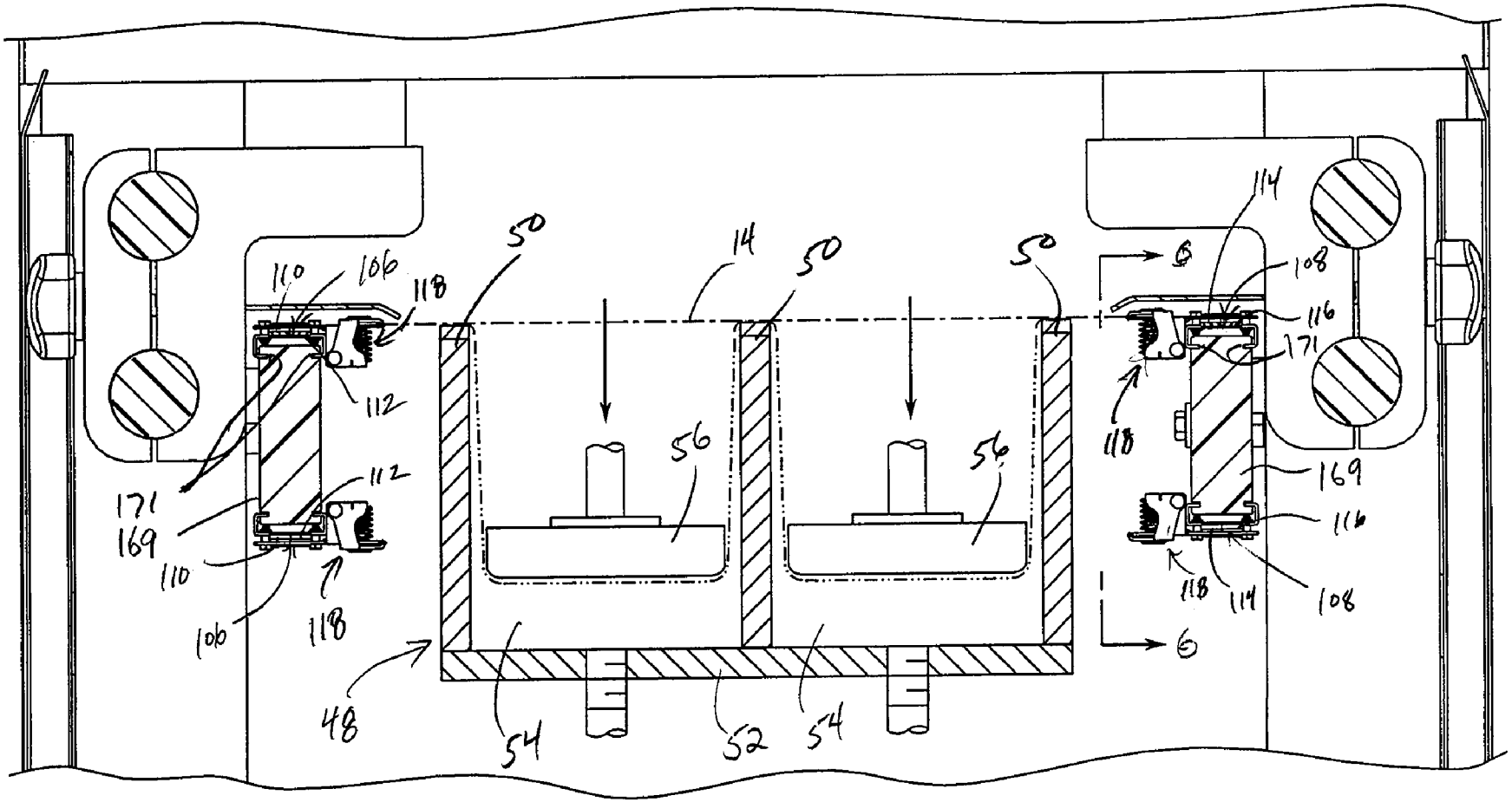
FIG. 3 is a section view of the packaging machine of FIG. 1 taken along line 3-3 of FIG. 2.

As further shown in FIG. 2, the formation station 18 includes a lift mechanism 46 that functions to move a formation box 48 between a lowered position and a raised position. Referring briefly to FIG. 3, the formation box 48 is defined by a series of side walls 50 that extend upwardly from a base 52. The spacing between the side walls 50 and the base 52 collectively form cavities 54 that may be evacuated using a vacuum (not shown) so as to draw the lower web material 14 into the cavities 54. More particularly, when the formation box 48 is in its fully raised position, the formation box 48 abuts an underside of lower web material 14. The cavities 54 may then be evacuated to draw the lower web 14 of flexible material downward into the cavities 54. Separate stamps or plug assist members 56 may also be used to help force the lower web 14 of flexible material into cavities 54 so as to deform the lower web 14 of flexible material. This process forms a number of cavities 20 in the lower web 14, which are adapted to receive product(s) to be packaged, as described with respect to FIG. 1).

Figure 4:
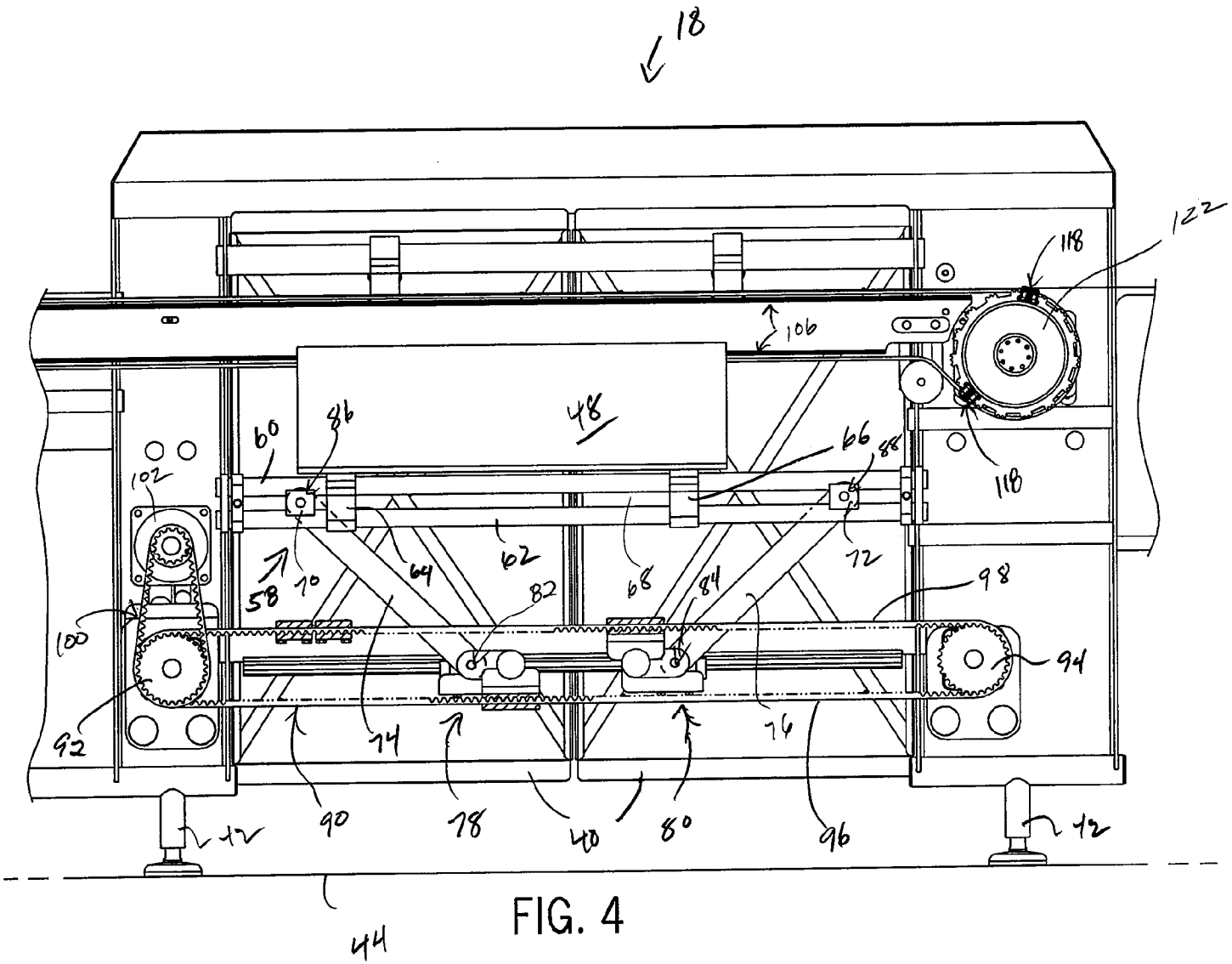
FIG. 4 is an enlarged view of a formation station of the packaging machine of FIG. 1.

Referring again to FIG. 2 and with further reference to FIG. 4, the formation box 48 is supported by a rack or frame 58 that includes a pair of plates 60, 62 oriented parallel to one another and coupled by a pair of braces 64, 66. The formation box 48 is mounted to the frame 58 by brackets 67. The braces 64, 66 hold the plates 60, 62 so that a slot 68 is formed between the plates 60, 62. The slot 68 defines a track along which a pair of rollers 70, 72 may translate. The rollers 70, 72 are each coupled to an arm 74, 76, respectively, which are connected to carriages 78, 80, respectively. The arms 74, 76 are connected to the rollers 70, 72 and carriages 78, 80 by pivot connections, generally shown at 82, 84, 86, and 88. These connections allow the arms to pivot relative to the carriages and the rollers. As shown in FIG. 4, each carriage 78, 80 supports a pair of arms, of which a single arm is shown for each carriage in FIG. 2.

The carriages 78, 80 are coupled, in a fixed connection, to a driven belt 90 that is trained around a driven pulley or wheel 92 and an idler pulley or follower wheel 94. As illustrated in FIG. 4, carriage 78 is connected to a lower run or belt portion 96 and carriage 80 is connected to an upper run or belt portion 98. The driven wheel 92 is driven by a drive belt 100 trained about the driven wheel 92 and a drive wheel 102. Rotation of drive wheel 102 causes rotation of driven wheel 92. As the driven wheel 92 is rotated, the driven belt 90 is rotated about its path defined by driven wheel 92 and follower wheel 94. Rotation of the driven belt 90 in a clockwise direction, resulting from a clockwise rotation of driven wheel 92, causes the carriages 78, 80 to move away from one another. Specifically, during a clockwise rotation of the driven wheel 92, the driven belt 90 causes carriage 78 to move toward the driven wheel 92 and causes carriage 80 to move toward the follower wheel 94. This movement also causes arms 74, 76 to pivot about pivots 82, 84, respectively. Moreover, the arms 74, 76 are caused to pivot about pivots 86, 88, respectively. Ultimately, this results in the arms 74, 76 moving toward a more upright position, which causes the rollers 70, 72 to roll within slot 68 toward one another and, as a result, raise the formation box 48. Similarly, when the driven wheel 92 and the driven belt 90 are rotated in a counterclockwise rotation, the carriages 78, 80 move toward one another and cause the arms 74, 76 to lower the formation box 48. In this regard, the driven belt 90 is a slave to the drive belt 100, such that the driven belt 90 is not translated along its rotational path until the drive belt 100 is translated along its rotational path.

Referring back to FIG. 2, in one embodiment, the sealing station 30 includes a lift mechanism 104 similar to that shown for the formation station 18 shown and described above with respect to FIG. 4. At sealing station 30, the lift mechanism 104 functions to raise and lower a tool in the form of a sealing anvil, which is used in sealing the upper and lower webs together in a manner as is known.

As further shown in FIGS. 2-3, the lower web 14 of flexible material is advanced from supply roll 16 through the formation station 18, the loading station 22, and to the upper web station 26 by a pair of belts 106, 108. Each belt 106, 108 is made up of separate side-by-side belt portions 110, 112 and 114, 116, respectively. The side-by-side belt portions 110, 112 and 114, 116 carry an array of clamps 118 that selectively grip and release edges of the lower web 14 of flexible material. The belts 106, 108 are trained about a respective pair of wheels, of which wheels 120, 122 associated with belt 106 are seen in FIGS. 2 and 4. One of the wheels 124 associated with belt 108 may be seen in FIG. 3. In a preferred embodiment, wheel 120, which is a drive wheel driven by a motor assembly 126, is located at or near the upper web station 24, whereas wheel 122 is a driven wheel posited at or near the supply roll 16. It is also understood that wheel 122 may be driven by a motor assembly. Further, it is also contemplated that both wheels 120, 122 may be separately motor driven. In a similar manner, wheel 124 is also a driven wheel and is rotated by a separate drive wheel (not shown), opposite drive wheel 120, via translation of belt 108.

Figure 5:
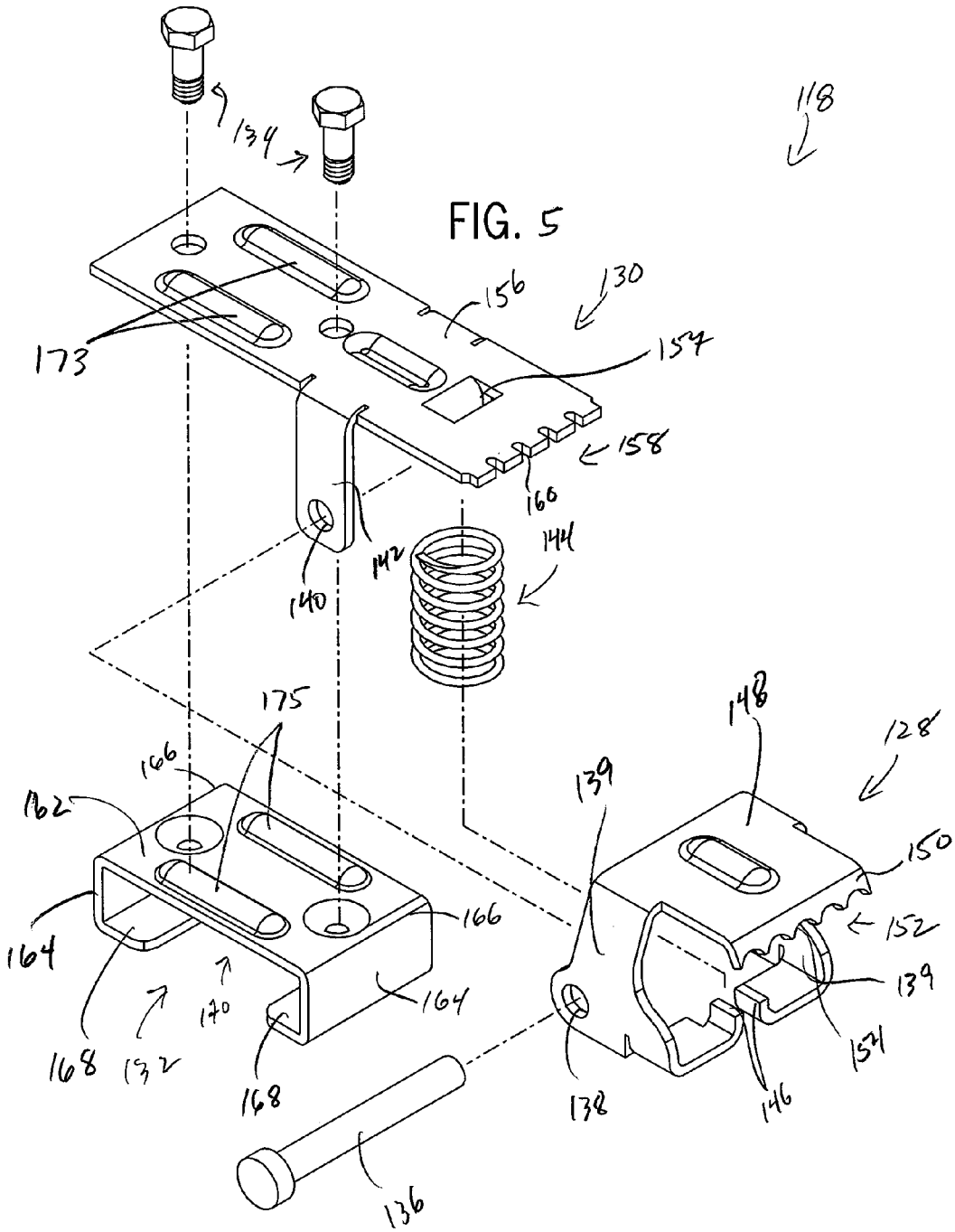
FIG. 5 is an exploded view of a belt driven clamp for use with the packaging machine of FIG. 1, according to one aspect of the invention.
Figure 7:
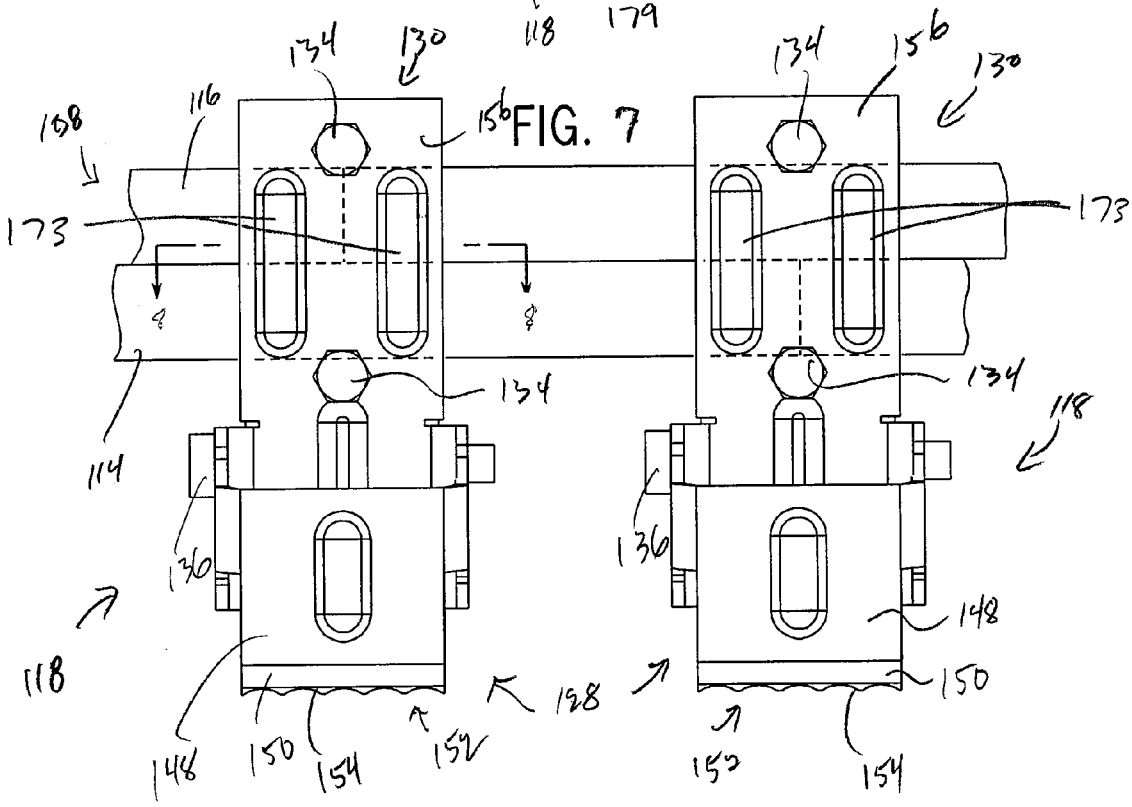
FIG. 7 is a section view of the packaging machine of FIG. 1 taken along line 7-7 of FIG. 6.

Referring now to FIGS. 5, 7 and 8, each clamp 118 is composed of a movable upper jaw member 128 and a fixed lower jaw member 130. The lower jaw member 130 is coupled to a channel guide member 132 by a pair of screws 134. A pivot pin 136 extends through openings 138 in a pair of spaced apart sidewalls 139 of the upper jaw member 128, and through openings 140 formed in a pair of downwardly extending tongues 142 of lower jaw member 130, of which only one tongue 142 is shown, to pivotably connect the upper jaw member 128 and the lower jaw member 130 to one another. A spring 144 defines a lower end that is seated on a pair of spaced apart, upwardly extending flanges 146 formed on a pair of lower tab member of the upper jaw member 128, to centrally position the spring 144 relative to the upper jaw member 128.

The upper jaw member 128 has a relatively flat and planar upper wall 148 with a sloped face or front wall 150 extending therefrom. The sloped face 150 has a serrated leading edge 152 that defines a series of gripping teeth 154. The lower jaw member 130 also a relatively flat and planar upper wall 156, but lacks the sloped face of the upper jaw member 128. The flat upper wall 156 of lower jaw member 130 has an alignment guide 157 which is configured to extend downwardly below the plane of upper wall 156, for engagement with the upper end of the spring 144 to align the spring 144 with the lower jaw member 180.

Similar to the upper wall 148 of the upper jaw member 128, the flat upper wall 156 of the lower jaw member 130 also has a serrated leading edge 158 defining a series of gripping teeth 160 that work in concert with the gripping teeth 154 of the upper jaw member 128 to grip the web of flexible material 14.

The upper jaw member 128 is selectively movable relative to the lower jaw member 130 between open and closed positions. In the closed position, the teeth 154 of the upper jaw member 128 engage the teeth 160 of upper jaw member 130, so as to clamp an edge area of the web of flexible material therebetween. Spring 144 functions to apply a downward biasing force on upper jaw member 128 at a location forwardly of pivot pin 136, to urge upper jaw member 128 toward the closed position. In the open position, upper jaw member 128 is pivoted about pivot pin 136 against the biasing force of spring 144, so as to move teeth 154 of upper jaw member 128 apart from the teeth 160 of lower jaw member 130. The upper jaw member 128 may be controlled in a known manner to pivot upwardly to the open position about pivot pin 136 against the bias of spring 144, to release the web of flexible material. As shown in FIG. 3, the upper jaw member 128 and the lower jaw member 130 are configured such that the respective teeth 154, 160 grip the web of flexible material along a plane that is generally parallel and between the plane of the upper walls 148, 156 of the upper jaw member and the lower jaw member, respectively. The plane on which the teeth 154, 160 grip the web of flexible material is preferably generally along a plane defined by the upper surface of the planar upper wall 156 of lower jaw member 130.

The channel guide member 132 has a relatively flat upper wall 162 and a pair of legs 164 extending downwardly from the edges 166 of the upper wall 162 at an angle that is perpendicular to the plane of the upper wall 162. Each leg 164 has an arm 168 extending perpendicularly from the leg 164 and in a plane parallel to that of the upper wall 162. The upper wall 162, legs 164, and arms 168 collectively define a C-shaped receiver, which is configured for engagement with a guide member 169 (FIG. 3). Each guide member 169 may be in the form of a guide block or rail formed of a low friction material, and which includes oppositely facing guide slots 171 within which arms 168 are adapted to be received. In this manner, the guide member 169 functions to axially guide movement of the belts 106, 108 along the length of the packaging machine 10.

Lower jaw member 130 includes a pair of axially spaced, upwardly extending protrusions 173 formed in upper wall 156. Similarly, channel guide member 132 includes a pair of axially spaced, upwardly extending protrusions 175 formed in upper wall 162. The spacing between protrusions 173 is generally equal to the spacing between protrusions 175.

Figure 6:
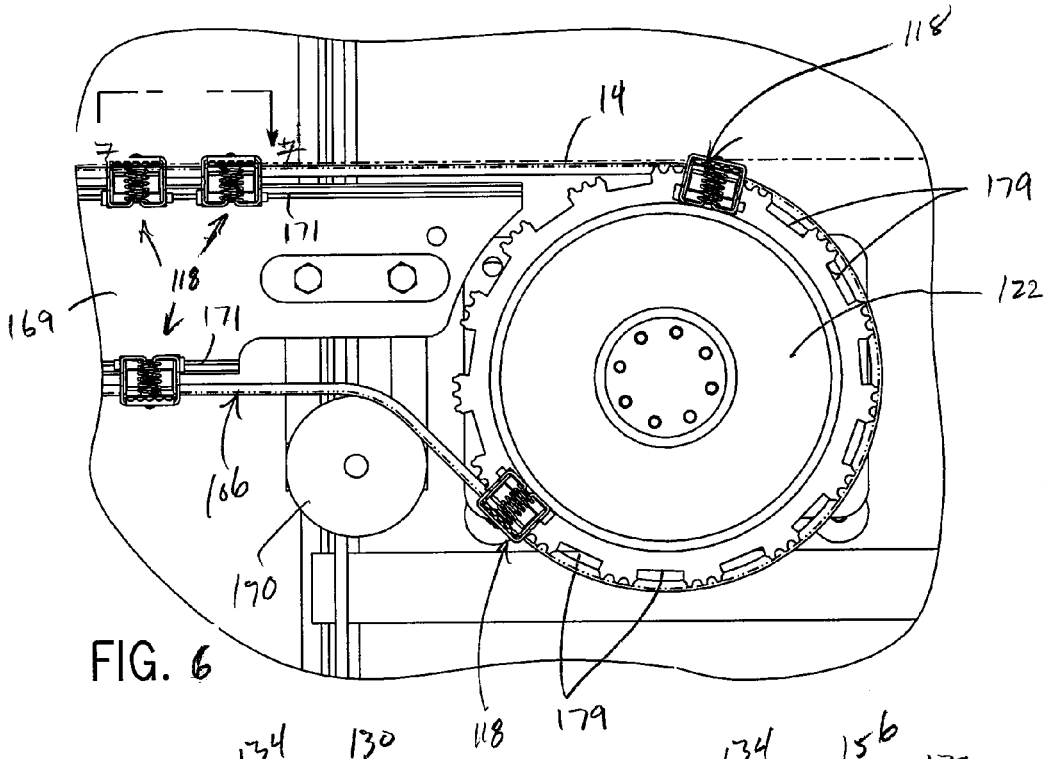
FIG. 6 is a section view of the packaging machine of FIG. 1 taken along line 6-6 of FIG. 3.

To couple each clamp 118 to one of the belts, as shown with respect to belt 108 in FIGS. 6-8, for example, the belt 108 is positioned between the lower jaw member 130 and the channel guide member 132. Screws 134 are then used to fasten the lower jaw member 130 to the channel guide member 132. When the screws 134 are tightened, the belt 108 is pinched or clamped between the lower jaw member 130 and the channel guide member 132. In this manner each clamp 118 may be secured to the belt 108 in a desired position along the length of the belt 108. As shown in FIG. 8, each belt 106, 108 is formed with teeth 177 along its length, which are configured for engagement with mating teeth on the wheels such as 120, 122, 124 to provide positive engagement between the belts 106, 108 and the associated wheels such as 120, 122, 124. The axial spacing between the protrusions 173 and the protrusions 175 matches the spacing between the belt teeth 177, such that the protrusions 173 are engaged within the spaces between a pair of adjacent teeth 177 when the lower jaw member 130 and the channel guide member 132 are secured together. The protrusions 177 provide an area of relief into which the area of the belt 106, 108 is received, to positively secure each clamp 118 axially along the length of the belt 106, 108.

As noted previously, the belts 106, 108 are formed of respective side-by-side belt portions 110, 112 and 114, 116. The clamps 118 are used to splice or secure the ends of the belt portions 110, 112, 114 and 116. As illustrated particularly in FIG. 8 with respect to belt portion 116 of belt 108, the ends of the belt portion 116 are positioned adjacent each other, between the protrusions 175, 177 of channel guide member 132 and lower jaw member 130, respectively. The clamp 118 is then secured over the adjacent ends of the belt portion 116, so that clamp 118 functions to maintain the ends of belt portion 116 together. The ends of the adjacent belt portion 114 are secured together in a similar manner. However, the ends of the adjacent belt portion 114 are secured together using a different one of clamps 118 than is used to secure together the ends of the belt portion 116, to provide an axially offset or staggered splice configuration. For example, the ends of the adjacent belt portion 114 may be secured together using a clamp 118 that is immediately adjacent the clamp 118 that is used to secured the ends of belt portion 116 together, although it is understood that any other clamp 118 at any other position along the length of the belt portion 116 may be used to secure the ends of the belt portion 114 together. In this manner, the forces associated with splicing together the ends of belts 106, 108 are distributed across the width of each belt 106, 108, since the protrusions 175, 177 have a length that spans across the width of each belt 106, 108. The protrusions 175, 177 thus not only function to maintain the ends of the belt portions 110, 112, 114 and 116 together, but also function to transfer stresses experienced at each splice to the adjacent belt portion. This feature is illustrated in FIG. 7, which shows the splice in belt portion 114 axially offset from the splice in belt portion 114, and the length of the protrusions 175, 177 spanning across the spliced ends of each belt portion 114, 116 as well as the laterally aligned area of the respective adjacent belt portion 116, 114. This construction allows the stress experienced by the splice in the belt 106 to be distributed over two axially offset locations, which enables the splicing function to be carried out by the clamps 118 without modification or reinforcement, and also without the need for a dedicated belt splice. While the belt 106 is shown and described as being split into two portions, it is also understood that any other number of belt portions greater than one may be employed while taking advantage of the offset belt splice function as shown and described.

Referring now to FIG. 6, an enlarged view of a portion of the formation station shows belt 106 trained about a guide roller 170 and around driven wheel 122. As shown in the figure, the clamps 118 remain connected to the belt 106 as the belt is translated by the driven wheel 124 and the drive wheel 120, FIG. 2. Each wheel includes circumferentially spaced recesses 179, which are configured to receive the channel guide members 132 of the clamps 118. The clamps 118 are designed to rotate with the belt 106, and to be moved to an open position as the clamp approached the web supply area, such as by operation of a cam-type opening arrangement as is known. When the belt 106 passes by the web feed area from web supply roll 16, the opening mechanism allows each clamp 118 to move to the closed position by operation of the spring 144, such that the gripping teeth 154, 160 of the respective upper and lower jaw members 128, 130 grip the web of flexible material and then advance the web material with the belt 106 in an indexed manner, although it is understood that the web of material may also be advanced in a continuous manner. As further shown in FIG. 6, the clamps 118 are engaged with the guide member 169 when discharged from the wheel 122, to maintain consistent travel of the belt 106 along the length of the packaging machine 10.

As was noted with respect to FIG. 2, the packaging machine 10 includes two belts 106, 108 spaced from one another, and each of which includes clamps 118 to grip and advance the web 14 of flexible material from the supply roll 16 through the various stations of the packaging machine. In one embodiment, optical sensors are used to provide feedback to motor controllers (not shown) for the respective motors (motor 126 for belt 106) so that operation of the motors for each belt can be synchronized. It is recognized that other types of sensors may also be used to provide positional feedback to the motor controllers for motor synchronization. Alternately, a single motor could be used to drive the drive wheels and thus the belts.

While the belt-driven clamping mechanism of the present invention has been shown and described as being formed of two side-by-side belts to which the individual clamping assemblies are mounted, it is contemplated that alternate designs are possible and are within the scope of the present invention. For example, the belt component may be a single belt, or may be three or more side-by-side belt sections secured together using the clamping assemblies. In an embodiment in which three or more belt sections are employed, the belt sections are spliced at offset locations using the clamping assemblies, as described above, to distribute stresses across a number of clamping assemblies rather than a single clamping assembly. In an embodiment in which a single belt is employed, the belt splice may be accomplished different ways in order to distribute splice stresses across several clamping assemblies. For instance, the belt ends may be cut diagonally at relatively shallow complementary angles, so that the splice spans across a number of clamping assemblies, such as six to eight clamping assemblies. Alternatively, the belt ends may have ends with stepped transverse cuts, so that the facing ends of each step are secured together using one of the clamping assemblies. A belt cut having any number of steps may be employed, to distribute the splice stresses across a desired number of clamping assemblies.

Many changes and will modifications could be made to the invention without departing from the spirit thereof. The scope of these changes will become apparent from the appended claims.

We claim:

1. A material advancement apparatus for advancing web material in a packaging machine, the apparatus comprising:

a drive arrangement;

a belt operatively associated to be driven by the drive arrangement along a predetermined path; and a clamp arrangement including a plurality of clamps coupled to the belt and adapted for selectively gripping and releasing the web material, each clamp having an upper jaw member pivotally engaged with a lower jaw member and having a pivot axis positioned below a plane along which the upper and lower jaw members grip the web material.

2. The apparatus of claim 1 wherein the belt includes a first belt portion and a second belt portion independent of the first belt portion.

3. The apparatus of claim 2 wherein the first belt portion is offset from the second belt portion.

4. The apparatus of claim 1 wherein the drive arrangement includes a drive motor operative to drive a first end of the belt, and a roller member engaged with a second end, opposite the first end, of the belt.

5. The apparatus of claim 4 including a pair of laterally spaced belts, each of which includes a clamp arrangement, and wherein the drive arrangement includes a pair of drive motors and a motor controller operative to synchronize operation of the pair of motors.

6. The apparatus of claim 1:

wherein the upper jaw member has a substantially flat upper wall and a downwardly sloping front wall extending from the upper wall, and having a plurality of downwardly extending gripping teeth; and wherein the lower jaw member has a substantially flat upper wall terminating in a plurality of gripping teeth that cooperate with the gripping teeth of the upper jaw member.

7. The apparatus of claim 6 wherein the upper wall of the upper jaw member extends along a first plane and the upper wall of the lower jaw member extends along a second plane spaced from and parallel to the first plane, and wherein the plane along which the upper and lower jaws grip the web material is between and parallel to the first plane and the second plane.

8. A clamping arrangement for a packaging machine that packages products in flexible web material, the clamping arrangement comprising a plurality of clamps, wherein each clamp includes:

a channel guide member adapted to engage a guide rail of the packaging machine;

a lower jaw member coupled to the channel guide member; and an upper jaw member coupled to the lower jaw member in a manner that allows the upper jaw member to pivot relative to the lower jaw member about a pivot axis located below a plane along which the upper and lower jaw members grip the web material.

9. The clamping arrangement of claim 8 wherein the channel guide member comprises:

a relatively flat wall;

a first leg and a second leg extending from the relatively flat wall and spaced from one another; and a first arm extending from the first leg and a second arm extending from the second leg, wherein the first arm and the second arm extend in a direction so as to be within a footprint of the relatively flat wall.

10. The clamping arrangement of claim 8 wherein the upper jaw member includes a substantially flat upper wall and a downwardly sloping front wall extending from the upper wall, and having a plurality of downwardly extending gripping teeth and the lower jaw member includes a flat upper wall with a slope-less front wall extending from the upper wall and a plurality of slope-less gripping teeth.

11. The clamping arrangement of claim 10 wherein the upper wall of the upper jaw member extends along a first plane and the upper wall of the lower jaw member extends along a second plane spaced from and parallel to the first plane, and wherein the plane along which the upper and lower jaw members grip the web material is between and parallel to the first plane and the second plane.

12. A combination clamping and advancing mechanism for moving web material through a machine, comprising:

a belt-type drive member defining a pair of ends; and a series of clamp members secured along the length of the belt-type drive member, wherein the clamp members are engaged with the belt-type drive member, and wherein axially spaced apart ones of the clamp members are configured to secure together the pair of ends of the belt-type drive member.

13. The combination clamping and advancing mechanism of claim 12, wherein the belt-type drive member comprises a pair of side-by-side belt portions, each of which defines a pair of ends, and wherein the ends of the belt portions are secured together at axially spaced apart locations by axially spaced apart ones of the clamp members.

14. A material advancement apparatus for advancing web material in a packaging machine, the apparatus comprising:

a pair of spaced apart, endless web material advancement components on opposite sides of the machine, wherein the web material advancement components are operable to grip the opposite edges of the web material; and a drive arrangement engaged with the web material advancement components, wherein the drive arrangement includes a pair of drive motors located one on each side of the machine, and wherein each drive motor is drivingly engaged with one of the web material advancement components, wherein the drive motors are operated synchronously in order to move the opposite edges of the web material at the same rate of speed through the machine;

wherein each web material advancement component comprises a toothed belt and a series of clamp members carried by the toothed belt, wherein the clamp members are configured to engage an edge of the web material, and wherein each drive motor is engaged with one of the toothed belts via a toothed drive wheel that is driven by the drive motor.

15. The material advancement apparatus of claim 14, wherein each clamp member is secured to the associated toothed belt by means of a mounting member, and wherein the toothed drive wheel includes a series of recesses that are configured to receive the mounting members when the belt is engaged with the drive wheel.

16. The material advancement apparatus of claim 14, wherein each toothed belt comprises a pair of side-by-side belt portions, wherein each belt portion defines a pair of ends, and wherein the clamp members are engaged with each belt to as to span across the side-by-side belt portions, and wherein axially spaced apart ones of the clamp members are configured to secure together the pair of ends of each belt portion.

* * * * *